US005511394A

United States Patent [19]

Shima

[11] Patent Number: 5,511,394

[45] Date of Patent: Apr. 30, 1996

[54] METHOD OF PRODUCING KNITTED ARTICLES

[75] Inventor: Masahiro Shima, Wakayama, Japan

[73] Assignee: Shima Seiki Manufacturing, Ltd., Wakayama, Japan

[21] Appl. No.: 334,342

[22] Filed: Nov. 2, 1994

[30] Foreign Application Priority Data

Nov. 8, 1993 [JP] Japan ..... 5-303319

[51] Int. Cl.[6] ..... D04B 1/00; D04B 39/00

[52] U.S. Cl. ..... 66/232; 66/54

[58] Field of Search ..... 66/54, 178 A, 66/231, 252

[56] References Cited

U.S. PATENT DOCUMENTS

| | | | |
|---|---|---|---|
| 4,502,301 | 3/1985 | Swallow et al. | 66/178 A |
| 4,526,017 | 7/1985 | Shima | 66/71 |
| 4,856,104 | 8/1989 | Stoll et al. | 66/232 X |
| 4,953,400 | 9/1990 | Bossuyt | 66/54 X |
| 5,388,050 | 2/1995 | Inoue et al. | 66/232 X |

FOREIGN PATENT DOCUMENTS

| | | |
|---|---|---|
| 0568700 | of 0000 | European Pat. Off. . |
| 0485005 | 5/1992 | European Pat. Off. . |
| WO93 06285 | 1/1993 | WIPO . |

OTHER PUBLICATIONS

U.S. Pat. No. 4,058,874 dated Nov. 1977 *col, 3, line 58–col. 4, line 61; FIGs. 1–10*.

*Primary Examiner*—John J. Calvert

*Attorney, Agent, or Firm*—Nikaido, Marmelstein, Murray & Oram

[57] ABSTRACT

Different kinds of texture samples smaller than the knitted fabric to be produced are knitted with different loop lengths and finished. The loop length and loop density for the fabric are determined from the sample having an optimum texture. The density obtained is applies to pattern data as to the fabric to determine wale and course numbers, and the fabric is knitted with the determined loop length and finished.

9 Claims, 4 Drawing Sheets

METHOD OF PRODUCING KNITTED ARTICLES

FIELD OF THE INVENTION

The present invention relates to a method of producing knitted articles, and more particularly to a method of producing a knitted article as designed in respect of texture, wale and course numbers and size without test production.

PRIOR ART

Knitted articles have the problem that the texture and size of the article can not be determined before the article is actually knitted and finished. With respect to texture, for example, knitted articles which are identical in wale and course numbers vary in texture owing to various conditions involved in the knitting process. Articles as knitted are finished as by soaping, milling and steaming, and shipped after the resulting shrinkage has been made saturated to some extent. The knitted article is altered in texture and also in size when subjected to the finishing process. Since different treatments are performed for finishing, the alteration of the texture resulting from the finishing process is unpredictable. This is also true with respect to the size; articles which are identical in wale and course numbers differ in size owing to minute variations in knitting conditions, peculiarity of the machine, humidity, kind of the material, etc., while the finishing process entails an altered size. For example, even when treated by basically the same finishing process, knitted articles exhibit different degrees of shrinkage or deformation due to slightly different conditions, e.g., differences in the temperature or duration of steaming and in season, or depending on the amount of material or yarn used or on the compactness of the loops. Accordingly, it is impossible to predict to what extent the finishing process alters the texture or size. For these reasons, articles of a desired texture or size are not available if they are knitted while only controlling the stitch data. Even if the stitch data is so determined as to compensate for the possible variation in size or texture with empirical consideration given to the influence of the knitting conditions and finishing conditions, the size nevertheless deviates from the target value by about ± several percent, and the texture is still undeterminable unless the article is actually knitted and finished.

Since the texture and size of knitted articles are unpredictable, test production is practiced in the knitting art. As literally apparent, the term test production means the trial of preparation the contemplated knitted article in actual size. Several kinds of samples are made by test production and finished to evaluate the resulting texture and size and determine the knitting conditions. However, test production is in no way suited to the production of many kinds of knitted products made in small quantities. For example, it is not justifiable to prepare several samples by test production in order to produce several design-oriented sweaters.

The variations in texture and size resulting from finishing are additionally related to the production lot unit and stock. When articles are produced in small additional quantities to meet the demand of customers, the texture and size will vary owing to the change of seasons and lack of reproducibility of the original finishing conditions. Accordingly, a choice must be made between production of articles which differ in texture or size from lot to lot and the running of a test production for every lot. Unpredictability of texture or size further influences the method of designing knitted articles.

Although the design of woven articles is specified by patterns, the design of knitted articles is specified by data as to the wale and course numbers and stitch data, and patterns are not in wide use. This is because even if a particular size is specified by a pattern, articles of the specified size are not available and also because the texture, which is characteristic of knitted articles, can not be expressed by the pattern.

To sum up, test production seriously impairs the productivity of knitted articles and hampers production of a wide variety of articles in small quantities. The need for test production is attributable to various fluctuating factors involved in the knitting process and to the shrinkage of knitted articles in the finishing process. The need for test production can be interpreted as indicating that articles of a particular size are not available even if the size is specified by a pattern.

As to the prior art concerned, it is known to form a knitted article while adjusting the loop length on the knitting machine by feedback control (e.g., Laid-Open Japanese Patent Publication 62,977/1987). This patent, nevertheless, fails to disclose knitting of a texture sample, nor does the publication mention anything about decision of the wale and course numbers by selecting an optimum sample from among finished samples and predicting the size of finished articles based on the optimum sample.

SUMMARY OF THE INVENTION

An object of the present invention is to eliminate the need of test production for knitted articles and to make it possible to produce articles having a desired texture, predetermined wale and course numbers and specified size without test production.

Another object of the invention is to make it possible to produce knitted articles having a desired texture in a size conforming to pattern data without test production.

Still another object of the invention is to provide a novel method of pattern knitting in place of Jacquared knitting or intarsia to produce a color pattern by locally giving different colors to the yarn to be fed to the carriage instead of producing a color pattern by knitting a plurality of yarns.

According to the present invention, different kinds of texture samples smaller than the article to be produced are knitted with varying loop lengths and finished, and the optimum texture sample is selected from among these samples. As a rule, the samples are finished in the same manner as the article to be produced. If an article is knitted with the same loop length as the optimum sample, the article has the same texture as the optimum sample. Thus, optimum conditions for texture can be determined without knitting an article of actual size. Next, the density of loops after finishing is determined from the size of the optimum sample and the wale and course numbers thereof per unit length. The required wale number and course number are then calculated by applying the density value to the size and shape of the contemplated article. When an article is knitted with the loop length of the optimum sample taken as the loop length thereof and finished by the same process as the texture sample, the article is available in the predetermined size and shape and given the same texture as the optimum sample.

While the present invention is useful especially for producing fashioned garments and integral knit articles, the invention is also applicable to knitting of non-fashioned fabrics and elongated fabrics. In the case of non-fashioned fabrics and elongated knitted fabrics, these products are, for example, rectangular, and the size is indicated in the knitting width or length. In knitting fashioned garments, it is difficult to predict the shape of the garment as finished, so that patterns are not generally used for specifying the design. However, according to the present invention which provides articles of a predetermined shape, the shape of the article is decided on first so as to prepare pattern data, and the wale and course numbers are determined by applying to the data the size of the optimum texture sample and the wale and course numbers thereof per unit length. To determine the wale and course numbers per unit length of the optimum sample as finished and the size thereof, preferably free of the influence of opposite ends of the sample, these items of data are taken from a striplike portion of the sample in the central part thereof and determined from the wale and course numbers counted per unit length in the vertical and horizontal directions and the size measured relative to a predetermined wale or course number in the vertical and horizontal directions. In this way, the contemplated article can be produced in conformity with the pattern data without test production. Integral knit articles can not be produced unless the size and location of the neck, pocket, button holes and like parts will appear can be predicted, whereas the present invention enables prediction of the position and size of these parts in the article as finished from the texture sample.

The decision of the size of the knitted article may precede the preparation and evaluation of the texture samples, and vice versa. For the control of loop length, the length of yarn is controlled for every loop, or may be controlled, for example, for every course, every several courses or every predetermined number of loops. In actual operation, it is simpler to measure the length of yarn per course or per group of several courses and effect feedback control for the next specified course than to measure the length of yarn for every loop and effect feedback control for every loop. To specify the size of the knitted article, pattern data, for example, is used instead of a pattern because data other than an actual pattern, such as a pattern on a CAD system, is useful insofar as the data is sufficient for deciding on the size of various parts of the knitted article. The term "pattern data" as used herein refers to design data for determining the shape and size of outlines of component parts of a fashioned article. As a rule, the type of knitting machine to be used is a weft knitting machine which is suited to the production of many kinds of articles in small quantities, and the knitting method is, for example, fashioning, non-fashioning or integral knitting.

The features described above result in the following advantages.

1) Articles of optimum texture and desired size can be knitted without test production. This facilitates production of many kinds of knitted articles in small quantities and results in a shortened lead time before actual production.
2) Articles can be designed based on pattern data instead of making the design with wale and course numbers, followed by test production and then by correction. Accordingly, the article can be so designed as to directly specify its shape from the start. This provides a new method of designing fashioned articles.
3) Products are available with diminished dimensional errors. In the case of non-fashioned articles, therefore, the knitted fabric need not have a margin for accommodating dimensional errors. With fashioned articles, the position and size of patterns are accurately controllable. Similarly in the case of integral knit articles, the position and size of pocket and like parts can be controlled. This facilitates modifications of designs and grading.

When knitted articles are produced while controlling the loop length, it is possible to predict at what positions in the fabric particular portions of the yarn respectively appear. It is therefore desirous to produce a knitted article using a yarn having different colors at different positions along the length thereof, and to identify loops which are to be formed respectively by particular portions of the yarn based on the data as to the loop length to determine the colors of the yarn. For example for this purpose, the yarn is dyed in different colors at different portions thereof and then fed to the knitting machine. Alternatively, yarns of different colors are provided on different cones as connected to the knitting machine, joined by a knotter or the like and fed to the carriage. In this way, even when a single yarn is fed to the carriage, a desired pattern can be produced in the knitted fabric. This is a novel knitting method which substitutes for Jacquard knitting or intarsia and by which the desired pattern can be produced with a small number of yarns. Consequently available is a light and smooth knitted fabric which is free of a rough or heavy feel due to the lining yarn as in Jacquard-knitted fabrics.

PREFERRED EMBODIMENT

Figure 1:
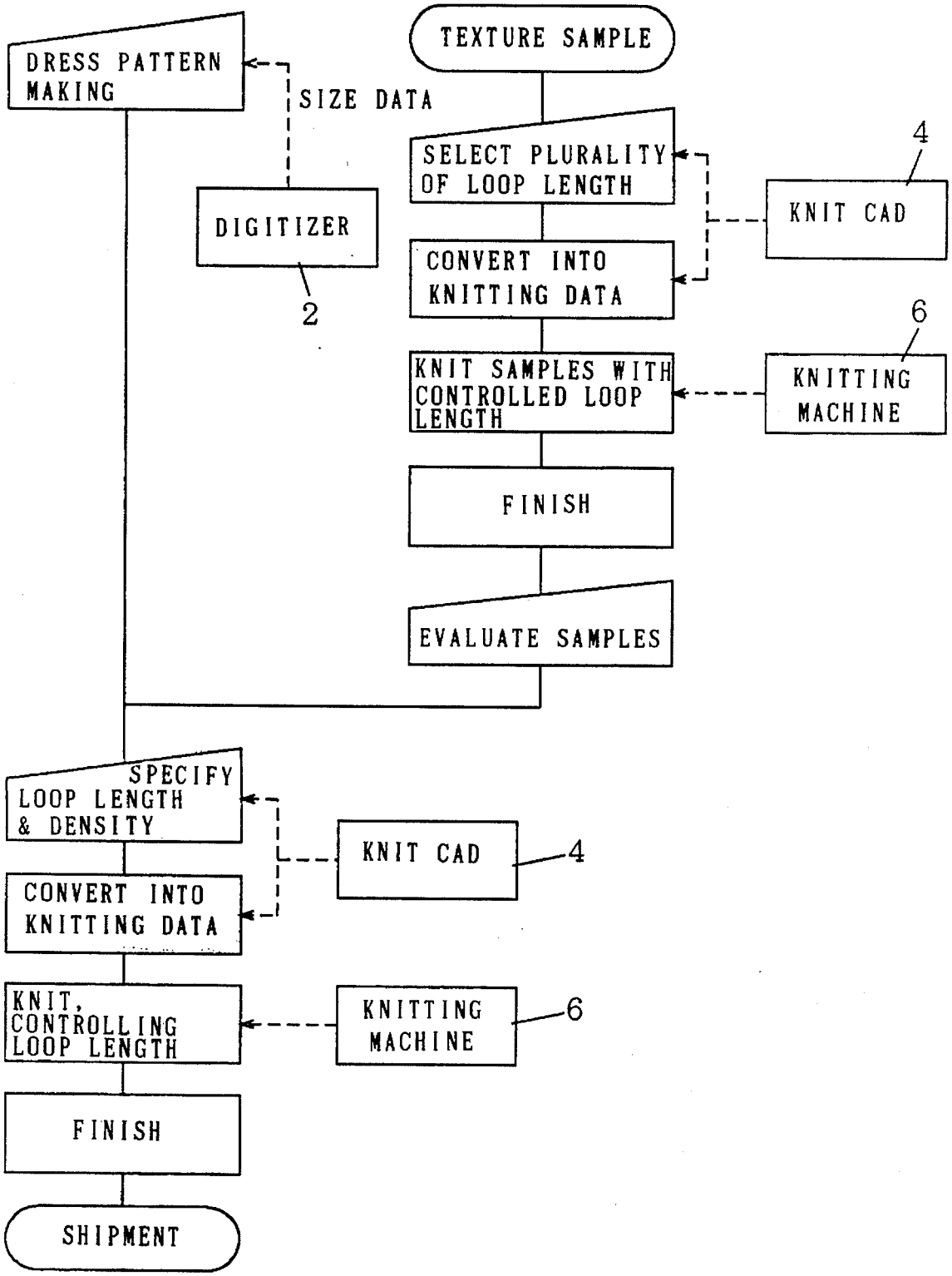
FIG. 1 is a flow chart of a method embodying the invention for producing knitted articles.

An embodiment and modifications thereof will be described with reference to FIGS. 1 to 5. FIG. 1 shows a production flow chart of knitted articles. For example, first pattern data as to the product is prepared to determine the size of parts thereof. The pattern data is prepared, for example, with a mouse or stylus using a digitizer 2, or may be prepared by inputting numerical values from a keyboard using a knit CAD system 4 or by causing a scanner to read an actual pattern. A workstation or computer of the same scale as personal computers and knit CAD software incorporated therein is useful as the knit CAD system. What is required as the pattern is not an actual pattern; the sizes of various parts needed for fashioning are necessary. In the case of the front body, they are the bottom width of the body, shoulder length, total length, shoulder position, neck form and like sizes. The pattern data prepared is stored in the knit CAD system 4.

The present invention is suited for fashioning and integrally knitting with use of pattern data, and is also usable for non-fashioning without fashioning data. In the latter case, the size of the knitted article means the width or length of a non-fashioned fabric. In the case of non-fashioning as in the former case, the invention readily affords a fabric of desired texture in a desired size, reduces the waste of yarn that would result when the fabric is knitted with the shrinkage due to finishing is considered to be somewhat greater than actually, and yet ensures the desired texture.

For example before or after the preparation of the pattern data, texture samples are knitted. The samples are then finished substantially in the same manner as the actual product. The alteration of texture or shrinkage due to finishing differs with slight differences in the conditions and is not reproducible, so that the texture samples are prepared, for example, before the production of the first lot and every time an additional lot is to be produced.

Figure 5:
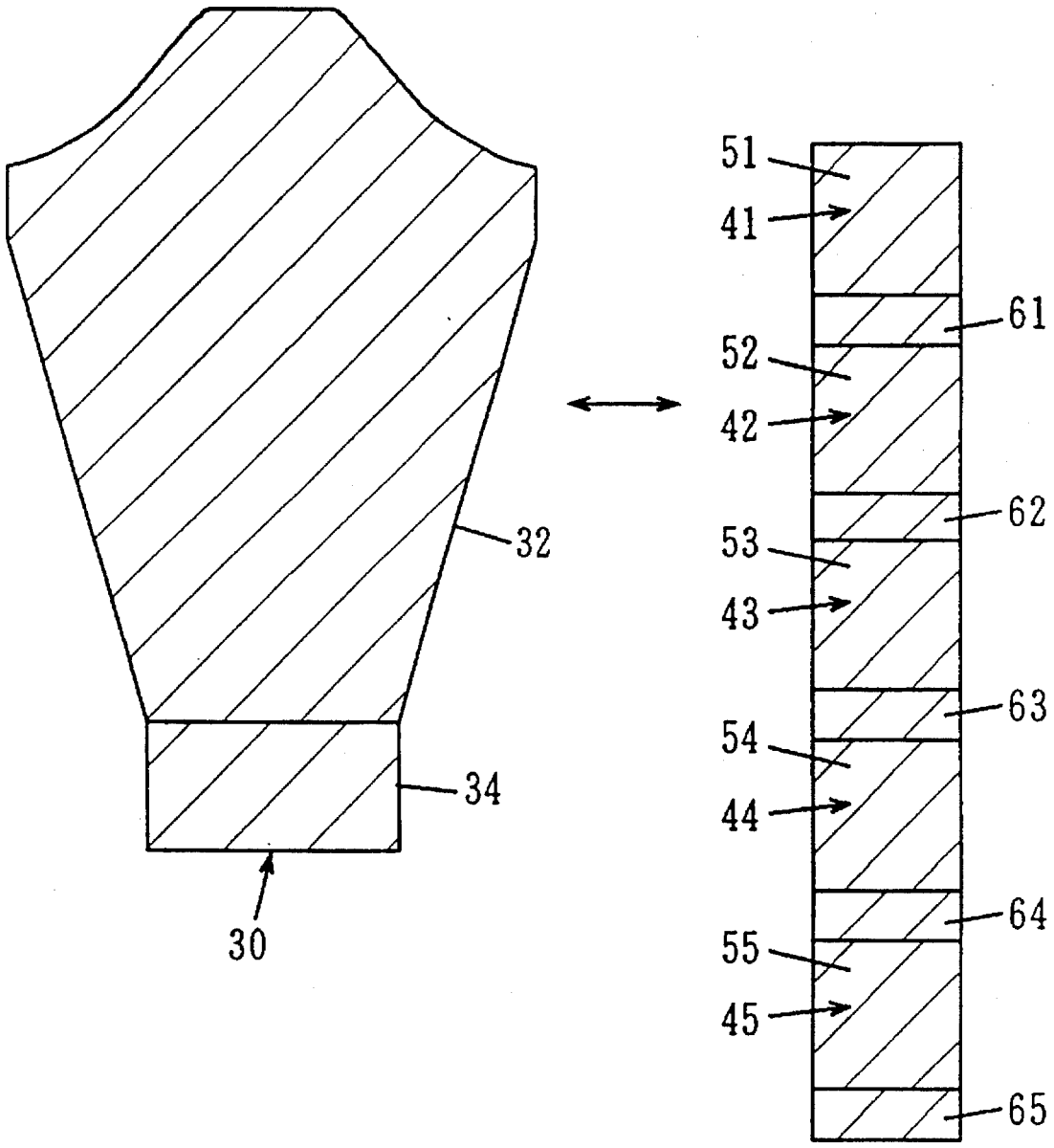
FIG. 5 is a diagram showing the relationship between pattern data as to a knitted article and texture samples.

FIG. 5 shows examples of texture samples. With reference to this drawing, indicated at 30 is the fabric to be knitted, and at 41 to 45 are five kinds of texture samples which are not separated from one another. The texture samples 41 to 45 are different in loop length (length of the yarn per loop) but are the same in wale number and course number. When the knitted fabric 30 comprises a jersey structure 32 and a rib structure 34, the texture samples 41 to 45 also include jersey structures 51 to 55 and rib structures 61 to 65. Each of the samples 41 to 45 is, for example, 15 to 30 cm (about 25 cm in the embodiment) in width and about 10 cm in length, and is smaller than the fabric 30 to diminish waste of the yarn. For the simulation, for example, of shrinkage involved in the knitting process and finishing, the texture samples 41 to 45 are fully serviceable when in a simple rectangular form. Narrowing or widening need not be simulated, nor is it necessary to simulate stitching. The loop length of the samples 41 to 45 is specified for each structure, and the rib structure and the jersey structure are made different in loop length.

With reference to FIG. 1 again. different loop lengths are specified for the respective texture samples 41 to 45, and wale and course numbers are determined in conformity with each loop length. These items of data are converted by the knit CAD system 4 into knitting data for a knitting machine 6, and the texture samples 41 to 45 are knitted with controlled loop lengths. The machine 6 is a weft knitting machine which is adapted to readily produce fabrics in a small lot unit by a single cycle. Subsequently, the samples 41 to 45 are finished in the same manner as the fabric 30, for example, by soaping or steam ironing for shrinkage. The shrinkage due to finishing is generally about several percent and markedly differs with variations in the finishing conditions. The shrinkage due to finishing also is dependent on the material and knitting method of the yarn, thickness of the fabric 30 and season, and is not reproducible. Accordingly, the samples 41 to 45 are prepared in the same season as the fabric 30 under the same conditions as the fabric to a controllable extent. The texture samples 41 to 45 are thereafter evaluated to select the optimum texture sample.

The texture of the optimum sample reflects the texture of the contemplated knitted fabric as finished. When the fabric 30 is knitted with the loop length controlled and finished, the fabric is given the same texture as the optimum sample. The wale number and course number of the knitted fabric are determined from the optimum sample. Suppose the texture sample 43 of FIG. 5 is optimum and has an initial knitting width, for example, of 25 cm. The wale number and the course number thereof are already known. The width of the sample as finished indicates the degree of shrinkage resulting from knitting and finishing. Conversely, the required wale and course numbers are determined from the shrinkage. However, to use the width of the optimum sample 43 simply for determination is not desirable since the width involves the influence of opposite ends of the fabric. Due to the influence of the folding over of the yarn, opposite ends of the fabric differ from the other portion in wale and course numbers per unit length. To avoid the influence of the opposite ends, therefore, preferably a central portion of the optimum sample 43, for example, a striplike central portion with a width of 10 cm, is checked for the wale and course numbers, and the wale and course numbers of the product are determined from the values obtained. Thus, these numbers are determined from the corresponding numbers per unit length of the optimum sample 43, as taken from a portion thereof other than its opposite ends.

The optimum sample provided the required loop length, wale number and course number, so that the sizes of the pattern data are expressed in wale and course numbers, the loop length of the optimum sample is used, and the values are input to the knit CAD system 4 for conversion into knitting data for the knitting machine 6. Since the pattern data is used, the intermediate portion between the bottom and the neck involves widening or narrowing, which is determined by interpolating the wale numbers decided on for the bottom and the neck, according to the pattern data for the intermediate portion. The machine 6 performs a knitting operation according to the knitting data with the specified wale and course numbers while controlling the loop length. For example, the stitch cam positions are feedback-controlled by measuring the length of yarn per course or per group of several courses and eliminating the difference between the measurement and the theoretical value of length of the yarn over a predetermined number of next courses.

The knitted fabric obtained is finished under the same conditions as the texture samples 41 to 45, whereby the fabric is given the same texture as the optimum sample. The texture sample and the fabric are basically similar. When the number of loops, for example, per 10 cm is measured from the central portion of the optimum sample as finished, the wale number and the course number of the actual product can be determined, whereby the product is obtained in conformity with the pattern data. For example, the length of the yarn per loop is controllable with an error of up to ±1% as will be described below, while the actual product is finished by the same treatment as the optimum sample, so that the dimensional error of the product is about ±1%. In the case where the texture samples 41 to 45 are not prepared, on the other hand, the dimensional error is approximately ±5% even if the knitting conditions are determined based on empirical prediction of the shrinkage to be involved in the knitting process and finishing process. The error is attributable chiefly to the shrinkage due to finishing and can not be eliminated merely by controlling the loop length during knitting. The texture is markedly altered by finishing and is therefore not predictable from wale and course number data.

Figure 2:
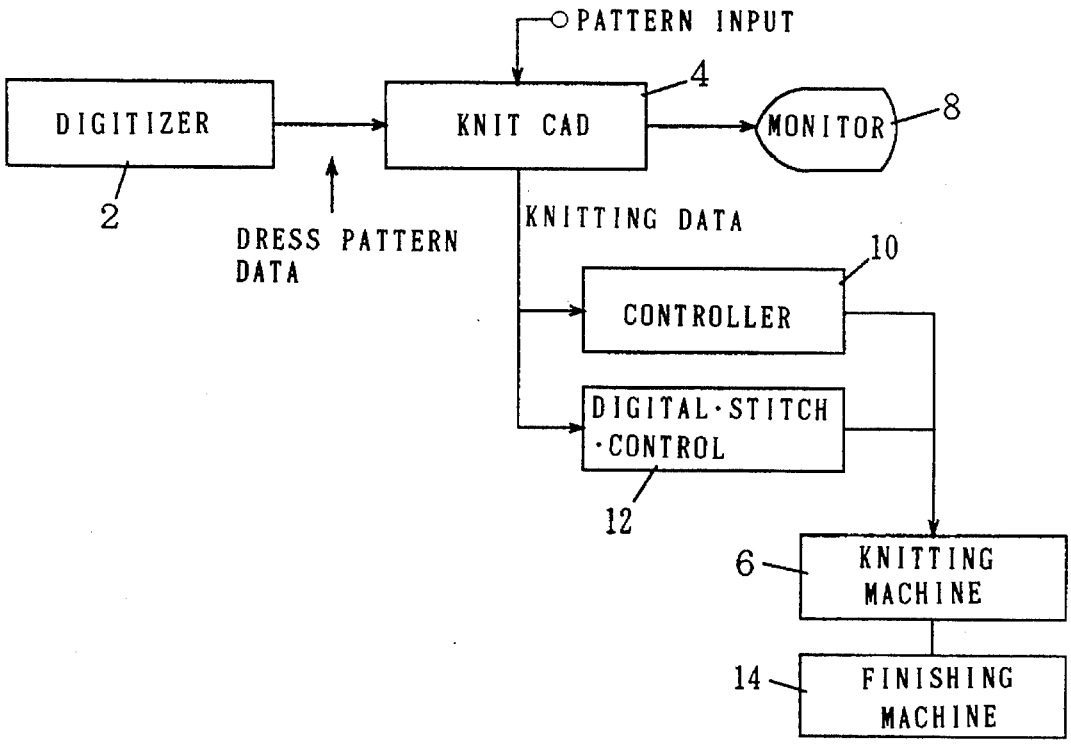
FIG. 2 is a block diagram of a production system useful for the embodiment.

FIG. 2 shows a production system. Indicated at 2 is the aforementioned digitizer, which is, for example, an A0 digitizer to which the pattern data is input with a mouse, or an A3 digitizer to which the pattern data is input with a stylus. Indicated at 4 is the above-mentioned knit CAD system which is adapted to accept inputs of pattern data as to patterns and structure patterns in addition to fashioning data.; A monitor 8 displays the fashioning data along with the pattern data. In the case of integral knitting, the positions and sizes of the neck, buttonholes, pocket, etc. are inputted. The CAD system 4 converts the sizes of the pattern data to wale and course numbers based on the wale and course numbers taken from the optimum sample per unit length thereof vertically and horizontally (taken from the sample central portion to avoid the influence of opposite ends). The system further determines the loop lengths of the structures 32, 34 from the loop lengths of the optimum sample. The knit CAD system 4 determines the size of the actual fabric from the optimum sample (from the wale and course numbers of the central portion thereof per unit length), and the monitor 8 displays an image simulating the actual knitted fabric in a size in proportion to the actual product. The size of the knitted product obtained by the system 4 is in correspondence with the pattern data with an error of not greater than one loop.

The knit CAD system 4 prepares knitting data specifying the overall wale and course numbers and the kind and position of structure for each course, feeds the data to a controller 10 for the knitting machine 6 and further feeds the loop length for each kind of structure to a digital stitch control 12. The control 12, which is combined with the controller 10, encodes the length of yarn to be fed from the cone to the knitting machine 6, detects the difference between the yarn length and the specified loop length and controls the stitch cam positions of the needle beds. The knitting machine 6 is controlled by the controller 10 and the digital stitch control 12. The fabric as knitted is treated with a finishing machine 14 by soaping, milling or steaming. The finished fabric has a size specified by the pattern data, the texture of the optimum sample, and the wale and course numbers determined by the CAD system 4.

The present invention which provides knitted articles or fabrics of desired texture and size has the following advantages.

1) The required amount of yarn is determined from the optimum sample and the size of the product, whereby the waste of yarn can be reduced.
2) Since test production is unnecessary, a wide variety of articles can be readily produced in small quantities. This eliminates the expense and time for test production.
3) Desired knitted articles can be designed without knowledge as to the shrinkage due to knitting and finishing. Conventionally, for example, knitted articles or fabrics can not be produced as designed unless the operator is experienced in shrinkage due to finishing or knitting and is aware of minute influences of differences in the conditions, change of seasons and peculiarity of the machine. On the other hand, with the method wherein texture samples are used, designs can be made and patterns specified with use of patterns. For this reason, even a person not versed specifically in the art of knitting can directly specify the configuration of the product to be obtained with a pattern for designing. Products of uniform quality are available free of the influence of peculiarity of the machine, humidity, etc. The peculiarity of the machine can be diminished through loop length control, while the influence of humidity can be reduced by producing the texture samples and actual article substantially at the same time. Accordingly, articles of uniform quality are available even when produced by a plurality of knitting machines 6. The influence of various conditions involved in the knitting process, and the shrinkage or deformation due to finishing can be checked with reference to the texture samples 41 to 45, and the conditions for giving an optimum texture can also be determined from the texture samples 41 to 45 at the same time. This improves the reproducibility of knitted articles. The shape of products is accurately controllable. This obviates the need for making the knitted fabric slightly larger than actually to accommodate errors in shape in the case of non-fashioning. Furthermore, it is no longer necessary to knit the component parts of the product as separated in wale-wise direction. For these reasons, the area of knitted fabric can be reduced by at least 10%. In the case of fashioned articles, products of uniform shape are available with the position and size of the pattern accurately controlled. These features facilitate grading or modification of the design. Further in the case of integral knitting, the size and position of the pocket and like parts can be controlled accurately.

Although the above embodiment has been described with reference to a fabric chiefly comprising a jersey structure 32, Jacquard-knitted fabrics or fabrics having a structural pattern or other structure can be produced similarly. In this case, the main structure is simulated with texture samples 41 to 45.

Figure 3:
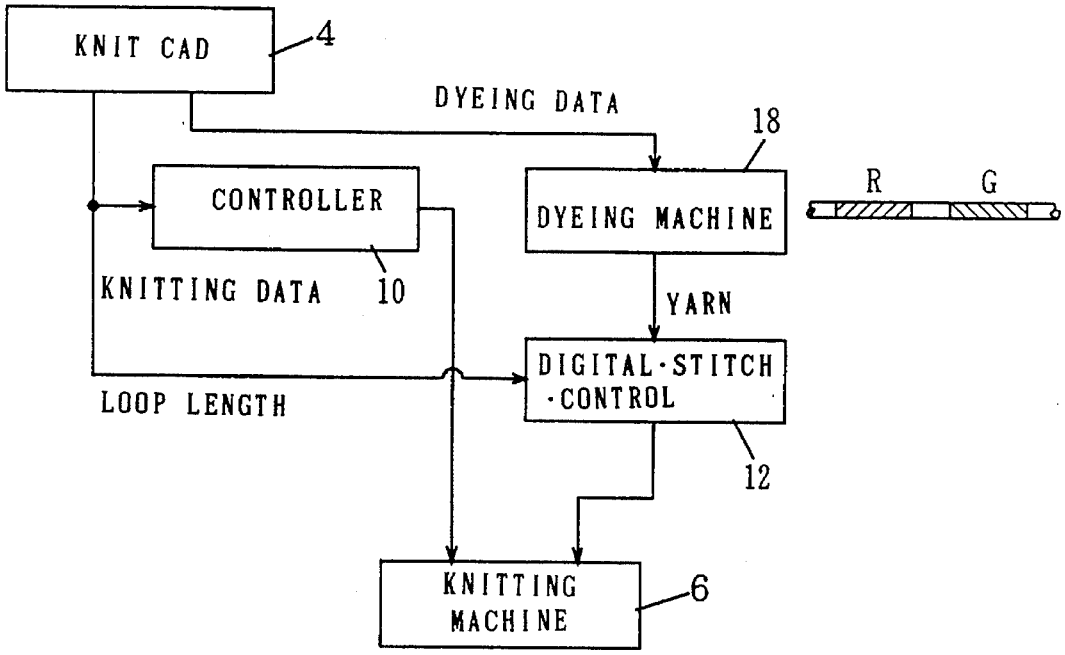
FIG. 3 is a fragmentary block diagram of a production system for a modification.

FIG. 3 shows a modification wherein a partly dyed yarn is used. When the wale number, course number and loop length are given, the positions in the contemplated knitted article where portions of the yarn are to appear respectively can be determined. To be accurate, the term the "portions of the yarn" means positions along the length of the yarn. For example, the portion of yarn fed to the dyeing machine is used for a loop to be positioned rearwardly away from the currently formed loop by the distance from the position of the machine to the carriage of the knitting machine 6 divided by the loop length. Accordingly, a dyeing machine 18 preceding the digital stitch control 12 is disposed for partly dyeing the yarn by padding, bubble jet or the like. The yarn is to be dyed only at portions which will appear as front loops, and is left undyed at portions where a color change occurs and which will be positioned as the rear side of loops (underside of other yarn) to avoid color mixture. For example, it is seen on the right-hand side of FIG. 3 that between a portion dyed red and a portion dyed green, an undyed portion is provided which forms a loop under other yarn. The knit CAD system 4 determines each position where the yarn is to be dyed in a particular color and feeds the dyeing data concerned to the dyeing machine 18. The yarn is fed to the knitting machine 6 while the amount of yarn used is being monitored by the digital stitch control 12.

Although different colors are given to the yarn by the dyeing machine 18 according to the modification, a plurality of cones, for example, may be prepared with a knotter interposed between the control 12 and the cones to supply yarns as joined together by the knotter. In this case, the knit CAD system 4 specifies the yarn color to be used for particular loops, and the control 12 controls the position of the yarn so as to present the specified color at the specified positions.

In this way, a color pattern can be produced in knitted articles by giving different colors to a single yarn. This obviates the need for Jacquard or intarsia knitting operation, consequently rendering the knitting machine 6 easy to control and reducing the waste of yarn since a fewer kinds of yarns are used. Because the yarn portion which does not appear on the front side need not be caused to jump to the next loop by lining unlike Jacquard knitting, knitted articles of improved quality are available. To give different colors to a single yarn does not mean to produce a knitted article only with the single yarn but means use of a smaller number of yarns than when different yarns are used for different colors.

Figure 4:
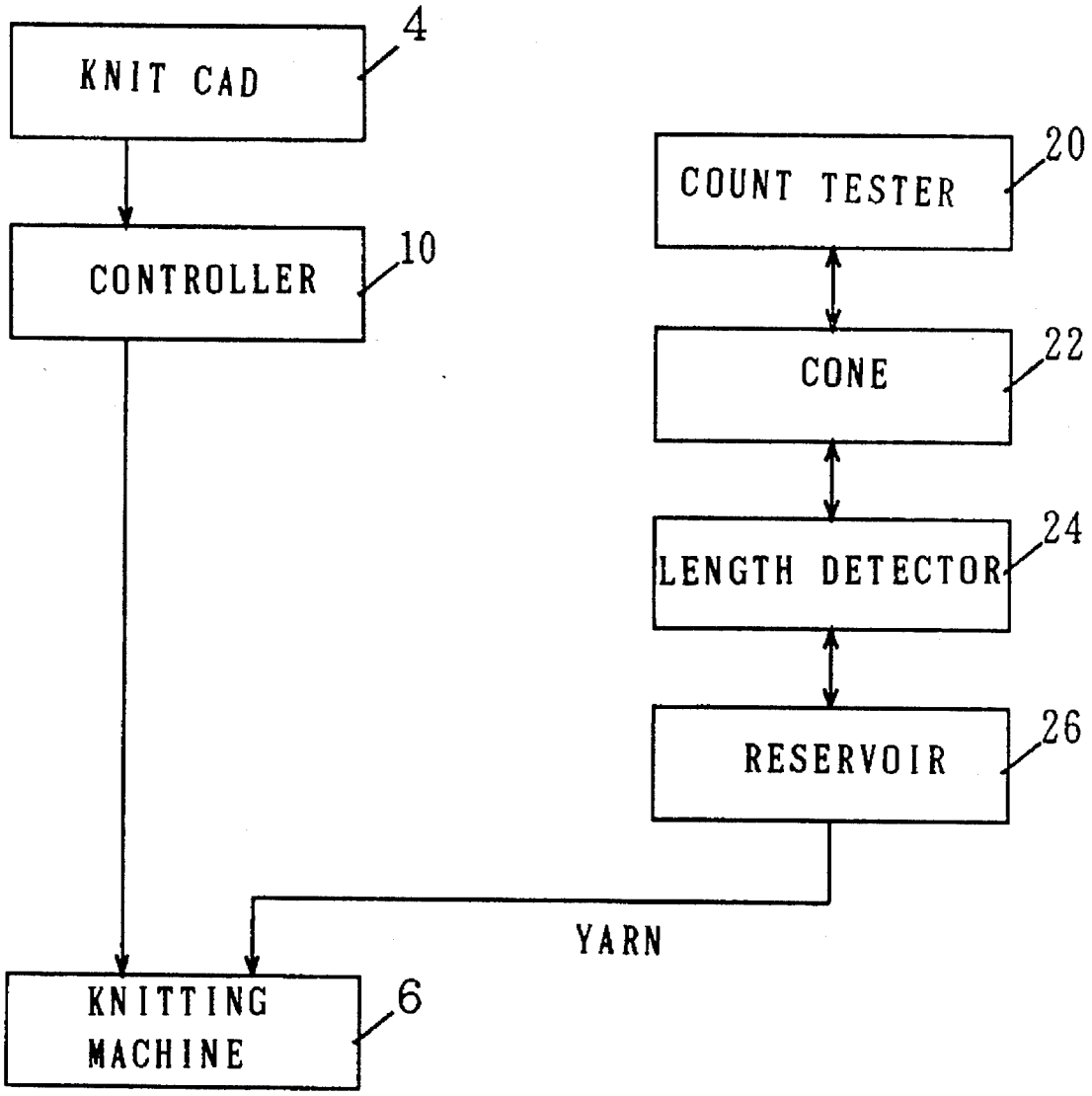
FIG. 4 is a fragmentary block diagram of a production system for another modification.

FIG. 4 shows another modification, wherein a reservoir 26 is used. Although yarn count is an important concept, yarn count is measured actually not frequently. Accordingly, the weight of yarn is measured while measuring the length of yarn to determine the yarn count. The total weight of yarn is known, so that for example if the weight per meter is given, the entire length of yarn on a cone 22 can be calculated, and the quantity of yarn used, when accurately controlled, indicates the number of cones 22 required for the control of the yarn. Next using a length detector 24, the length of yarn to be used for a specified number of subsequent loops (e.g. for the next one course) is supplied to the reservoir 26, which in turn feeds the yarn to the knitting machine 6. The reservoir 26, which serves as a substitute for the digital stitch control 12, does not control the length of yarn for every loop but controls the length of yarn for a specified number of loops and feeds a required quantity of yarn to the knitting machine 6.

What we claim is:

1. A method of producing a knitted article while controlling loop length, comprising the steps of:

determining a shape and size of a knitted article to be produced, knitting different samples having varying texture and loop lengths in a size smaller than said the determined size, finishing the samples and thereafter evaluating the samples to select an optimum sample, determining the loop length of the knitted article to be produced from a loop length of the optimum sample and determining a wale number and course number of the knitted article to be produced from the size of the finished optimum sample, and knitting the article with the determined wale number and course number while controlling the loop length so that the loop length corresponds with the determined loop length.

2. A method of producing a knitted article as defined in claim 1 wherein the knitted article is a fashioned article or an integrally knitted article, the method further comprising determining the wale number and the course number of the article to be produced by using pattern data as to the knitted article as the size of the knitted article and by applying the size of the finished optimum sample to the pattern data.

3. A method of producing a knitted article as defined in claim 1 further comprising producing the knitted article with use of at least one yarn having different colors at different positions along a length thereof, and identifying loops to be formed by portions of the yarn respectively based on data as to the loop length of the article to determine the color of the yarn at different positions along the length of the yarn and to cause specified loops to assume a predetermined color.

4. A method of producing a knitted article as defined in claim 3 further comprising dyeing yarn in different colors at different positions along the yarn length based on data as to the loop length.

5. A method of producing a knitted article while controlling loop length, comprising the steps of:

determining a shape and size of a knitted article to be produced, knitting different samples having varying texture and loop lengths in a size smaller than the determined size, finishing the samples and thereafter evaluating the samples to select an optimum sample, determining the loop length of the knitted article to be produced from a loop length of the optimum sample and determining a wale number and a course number of the knitted article to be produced from wale and course numbers thereof per unit length of the optimum sample, and knitting the article with the determined wale number and course number while controlling the loop length so that the loop length corresponds with the determined loop length.

6. A method of producing a knitted article as defined in claim 5 wherein the knitted article is a fashioned article or an integrally knitted article, the method further comprising determining the wale number and the course number of the article to be produced by using pattern data as to the knitted article as the size of the knitted article and by applying the wale and course numbers thereof per unit length to the pattern data.

7. A method of producing a knitted article as defined in claim 5 wherein the wale and course numbers of the finished optimum sample is measured at a central portion of the optimum sample.

8. A method of producing a knitted article as defined in claim 5 further comprising producing the knitted article with use of at least one yarn having different colors at different positions along a length thereof, and identifying loops to be formed by portions of the yarn respectively based on data as to a loop length of the article to determine the color of the yarn at different positions along the length of the yarn and to cause specified loops to assume a predetermined color.

9. A method of producing a knitted article as defined in claim 5 further comprising dyeing yarn in different colors at different positions along the yarn length based on data as to the loop length.

* * * * *